US006257144B1

(12) United States Patent
Erhardt et al.

(10) Patent No.: US 6,257,144 B1
(45) Date of Patent: Jul. 10, 2001

(54) METHOD OF METERING DAMPENING SOLUTION WHEN PRINTING WITH A PRINTING FORM FOR OFFSET PRINTING

(75) Inventors: Stephan Erhardt, Ketsch; Franz Haaf, Sinsheim-Weiler; Nikolaus Pfeiffer, Heidelberg, all of (DE)

(73) Assignee: Heidelberger Druckmaschinen Aktiengesellschaft, Heidelberg (DE)

( * ) Notice: Subject to any disclaimer, the term of this patent is extended or adjusted under 35 U.S.C. 154(b) by 0 days.

(21) Appl. No.: 09/326,364

(22) Filed: Jun. 4, 1999

(30) Foreign Application Priority Data

Jun. 4, 1998 (DE) ..... 198 24 927

(51) Int. Cl.[7] ..... B41F 7/26

(52) U.S. Cl. ..... 101/484; 101/148; 101/DIG. 45; 101/147

(58) Field of Search ..... 101/147, 148, 101/484, DIG. 45, 483, 450.1, 365, 366

(56) References Cited

U.S. PATENT DOCUMENTS 3,587,460 * 6/1971 Chambon ..... 101/148
4,156,388 * 5/1979 Mabrouk et al. ..... 101/148
5,887,521 * 3/1999 Nakamura ..... 101/147

FOREIGN PATENT DOCUMENTS 108687 6/1983 (DE) .
3611631A1 10/1987 (DE) .
19506639 C2 3/1997 (DE) .

OTHER PUBLICATIONS

Japanese Patent Abstract No. 06344533 A (Tomoaki), dated Dec. 20, 1994.

* cited by examiner

*Primary Examiner*—John Hilten
*Assistant Examiner*—Leslie J. Grohusky
(74) *Attorney, Agent, or Firm*—Herbert L. Lerner; Laurence A. Greenberg; Werner H. Stemer

(57) ABSTRACT

A method of metering dampening solution when printing with a printing form for offset printing, including, with a control device, setting an amount of dampening solution on the surface of the printing form to a predetermined value before starting to print, further includes, following one interruption in the printing, determining the number of interruptions which have occurred previously in a predefined time interval, and varying in accordance with the number of interruptions the amount of dampening solution supplied to the surface of the printing form during the one interruption.

3 Claims, 6 Drawing Sheets

14
10
15
11
16
12
17
18
21
20
9
1
13
19
23
22
Drive
24
25
2
Tachogenerator
3
5
4
7
6
Motor
Control Device
Rotary Encoder
8

METHOD OF METERING DAMPENING SOLUTION WHEN PRINTING WITH A PRINTING FORM FOR OFFSET PRINTING

BACKGROUND OF THE INVENTION

Field of the Invention:

The invention relates to a method of metering dampening solution when printing with a printing form for offset printing. In order to achieve a desired printing result when printing with a wet offset printing machine, it has been known to control or regulate the proportion of dampening solution in an emulsion of printing ink and dampening solution to be applied to a printing form. The actual portion or share of dampening solution can be determined with suitable detectors which are directed towards the surface of the printing form. The portion can be determined indirectly by evaluating signals from an image recording device or a densitometer, which are directed toward locations on the printing material which are free of a printed image, the extent of scumming or smearing that occurs being a participant therein. The composition of the emulsion must be set to an optimum value before printing is begun and during the production of first prints, otherwise prints which are not of suitable quality will be produced. The composition of the emulsion is disrupted if printing is interrupted. In order to obtain the desired composition of the emulsion as quickly as possible, it has become known to continue to dampen the printing form or plate for a predefined number of revolutions of the form or plate cylinder after printing has been interrupted. Furthermore, it has become known to set the supply of dampening solution operating again for a predefined number of revolutions of the plate cylinder before printing is continued. Post-dampening after an interruption may last for thirty-two revolutions, for example, whereas predampening before continuing to print may be performed for six revolutions of the plate cylinder. Premoistening may take place initially with a maximum supply rate and be continued with a supply rate that is suitable for continuous printing. In the case of rotary printing machines, premoistening and after or post-moistening may take place on the surface of the printing form or plate or on the surfaces of inking rollers which can be brought into contact with the surface of the printing form or plate. In conventional inking units, bridge rollers are provided, which produce a connection between rollers feeding dampening solution and printing ink (published German Patent Document DE 195 06 639 C2).

The procedure described hereinabove is implemented by control devices, which operate in accordance with a program. A printing machine operator, however, also has the possibility of changing the predampening and after or post-dampening times by manual entry, how the entered numbers of revolutions of the plate cylinder are optimally adapted or matched to the properties of the printing material, the printing image, the material of the printing form or plate, the transfer properties of a transfer cylinder and the properties of ink and dampening solution being determined by the experience of the operator. The operator cannot take into account the frequency and the duration of the interruption, because they are unable to be predicted by him or her.

SUMMARY OF THE INVENTION

It is accordingly an object of the invention to provide a method of metering dampening solution when printing with a wet offset printing plate, which affords a reduction in the number of prints of nonsuitable quality.

With the foregoing and other objects in view, there is provided, in accordance with the invention, a method of metering dampening solution when printing with a printing form for offset printing, including, with a control device, setting an amount of dampening solution on the surface of the printing form to a predetermined value before starting to print, which comprises, following one interruption in the printing, determining the number of interruptions which have occurred previously in a predefined time interval, and varying in accordance with the number of interruptions the amount of dampening solution supplied to the surface of the printing form during the one interruption.

In accordance with another mode, the method invention includes additionally determining the duration of the interruptions which have occurred previously in a predefined time interval, and increasing the amount of dampening solution supplied to the surface of the printing form during the one interruption, if the duration of the interruptions is increasing.

In accordance with a concomitant mode, the method invention includes applying the dampening solution to the surface of the printing form by rollers, and reducing the speed of one of the rollers timely and more rapidly during the one interruption when the number of interruptions is increasing.

By applying the method according to the invention, the restarting of a wet offset printing machine following an interruption can be optimized. The control system of the printing machine contains stores for pre-set values and parameters which have an influence upon the amount of dampening solution to be used. In offset printing machines, in which the dampening solution is applied to the surface of a printing plate by using a dampening-solution roller that can be brought into and out of contact, i.e., thrown on and thrown off, it is possible to enter the number of revolutions of a plate cylinder during which the dampening-solution roller is to be brought into contact with the printing plate, for the purpose of predampening before restarting the printing, the number of revolutions during which the dampening-solution roller is to remain in contact with the surface of the printing plate for the purpose of after or post-dampening, the speed of the dampening-solution roller during post-dampening, and the number of revolutions of the plate cylinder during which the dampening-solution roller is to apply a maximum amount of dampening solution to the surface of the printing plate when predampening. In the case of multicolor printing, the initial variables of the printing units, entered before printing, may be different, and this may depend, for example, upon the properties of the respective printing ink. The printing inks may have different viscosities and may exhibit a different tendency when mixing with the dampening solution. In addition, it is possible for a special dampening solution to be used in one of the printing units because of the printing ink used therein, and the properties of the dampening solution, for example the different pH thereof, can likewise be taken into account. In order to facilitate the operation of the printing machine, the entered values may be stored in the form of parameter sets, which are called up for use by the operator of the printing machine before printing. In the event of parameter sets being provided, the properties of the printing material, in particular the thickness and the absorption behavior and the area coverage in the printing image, can be taken into account.

The time duration of printing interruptions and production or continuous printing phases, and the number of printing interruptions, are recorded in a further storage or memory. According to the method invention, the values for the number of revolutions of the plate cylinder and the supply rate of the dampening solution during printing interruptions are varied continuously as a function of the number and the duration of the interruptions and, respectively, the duration of production printing phases. In wet offset printing machines, wherein zonal metering of the dampening solution transversely to the transport direction of the printing material is possible, the supply rate can be adapted or set in accordance with the average area coverages of the zones, it being possible to take into account the influence of the metering in one zone on adjacent zones.

Other features which are considered as characteristic for the invention are set forth in the appended claims.

Although the invention is illustrated and described herein as a method of metering dampening solution when printing with a printing form or plate for offset printing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
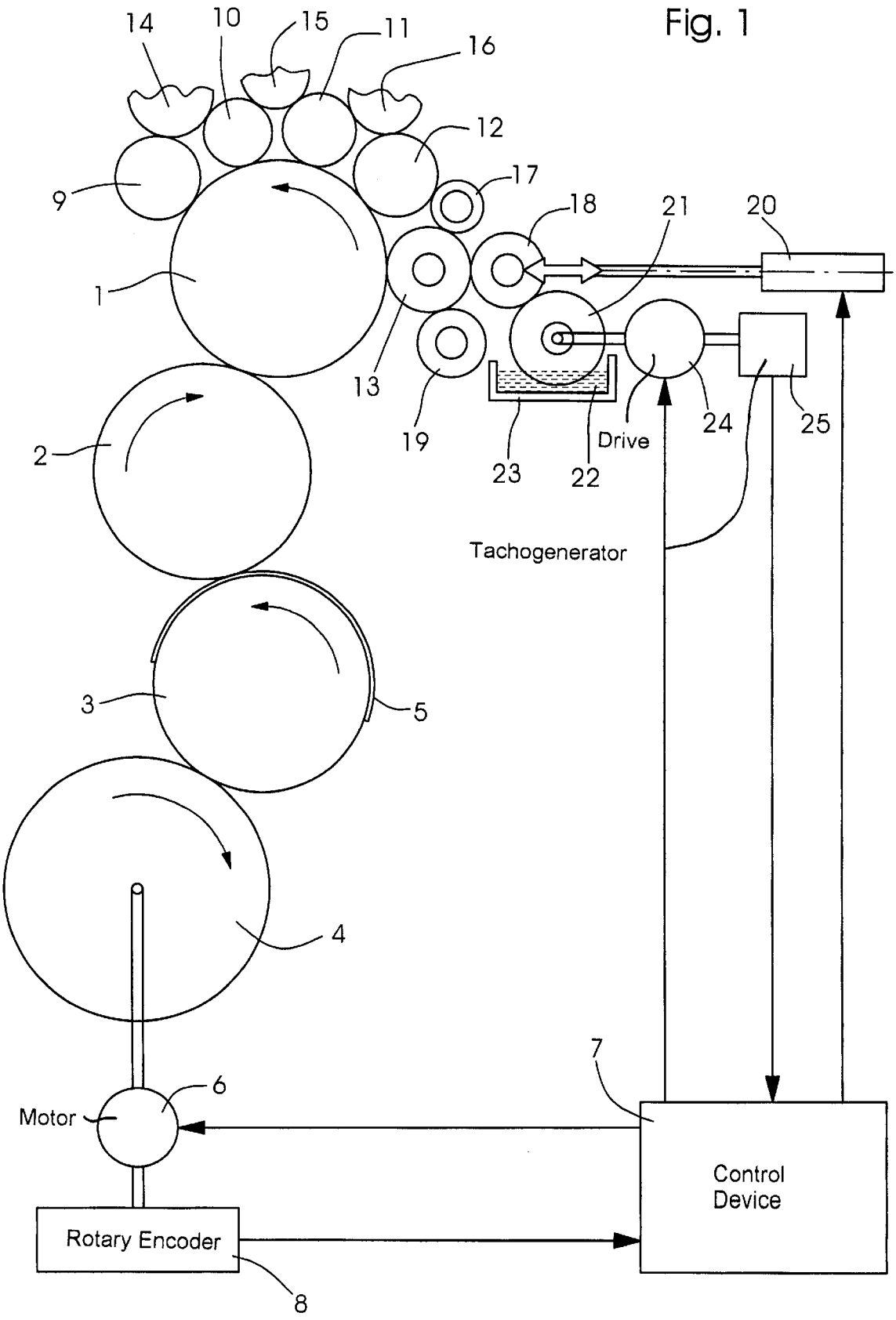
FIG. 1 is a diagrammatic side elevational view of a printing unit with devices for implementing the method according to the invention.

Referring now to the drawings and, first, particularly to FIG. 1 thereof, there is shown diagrammatically therein a typical roller plan or layout in a printing unit of a sheet-fed offset printing machine. A form or plate cylinder 1, a transfer cylinder 2 and an impression cylinder 3 are coupled to one another via a gear train. The gear of the impression cylinder 3 is connected to a drive gear 4. The plate cylinder 1, the transfer cylinder 2 and the impression cylinder 3 have substantially like diameters, so that with each revolution of the plate cylinder 1, a print is produced on a sheet 5, that is conveyed on the impression cylinder 3 through a printing nip between the transfer cylinder 2 and the impression cylinder 3. The drive gear 4 is coupled to a motor 6 that is connected to a control device 7. Coupled to the shaft of the motor 6 is a rotary encoder 8 that emits a signal proportional to the rotational angle, the signal being transmitted to a control device 7. Provided on the plate cylinder 1 is a printing form or plate for planographic printing which, during printing, is in contact with ink applicator rollers 9, 10, 11 and 12 and a dampening-solution applicator roller 13. The ink applicator rollers 9 to 12 and the dampening-solution applicator roller 13 can be brought into and out of contact with the plate cylinder 1. The ink applicator rollers 9 to 12 are in rolling contact with inking rollers 14, 15 and 16, which effect the transfer of printing ink from an ink fountain or duct to the ink applicator rollers 9 to 12. The dampening-solution applicator roller 13 is in rolling contact with an intermediate roller 17, a dampening-solution transfer roller 18 and a compensating roller 19 during printing. The dampening-solution transfer roller 18 can be brought into and out of contact with the dampening-solution applicator roller 13 with the aid of a pneumatic cylinder 20. The pneumatic cylinder 20 is activated by the control device 7. In the in-contact state, the dampening-solution transfer roller 18 forms a bridge between a dampening roller 21 and the dampening-solution applicator roller 13. The dampening roller 21 dips into dampening solution 22 that is received in a supply container 23. The dampening roller 21 is coupled to a drive 24, to which a tachogenerator 25 is synchronously coupled. The drive 24 and the tachogenerator 25 are connected to the control device 7. When the dampening roller 21 is set into rotation with the aid of the drive 24 during the printing operation, a defined amount of dampening solution is then supplied to the surface of the plate cylinder 1 in proportion with the rotational speed of the dampening roller 21. The signal present at the output of the tachogenerator 25 is likewise proportional to the rotational speed of the dampening roller 21.

Figure 2:
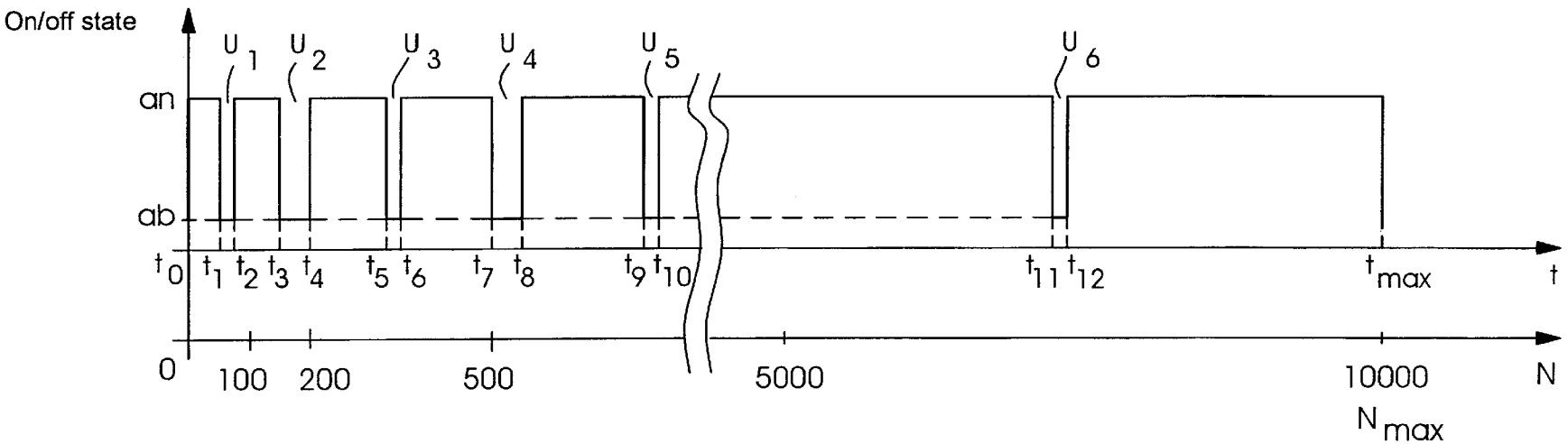
FIG. 2 is a plot diagram or graph relating to the on/off state of a printing machine.

Hereinafter, what is sought to be explained in greater detail is how the method can be implemented with the aforedescribed printing unit. Illustrated in FIG. 2 is a timing or time rate of change diagram representing the on/off switching state of the sheet-fed offset printing machine during the processing of a printing job for 10,000 prints. In order to process the printing job, six interruptions $U_1$–$U_6$ were required. It is believed to be apparent that, in a set-up and adjustment phase from the start of printing at a time $t_0$ to a time $t_{10}$, more interruptions $U_1$14 $U_5$ were required than in the production printing phase between the times $t_0$ and $t_{max}$, wherein only one interruption $U_6$ occurred. The interruptions $U_1$–$U_6$ occurred at different intervals. When starting up the printing operation, respectively, at the times $t_0$, $t_2$, $t_4$, $t_6$, $t_8$, $t_{10}$ and $t_{12}$, the pneumatic cylinder 20 is actuated first, so that the dampening-solution transfer roller 18 is brought into contact with the rotating dampening roller 21 and the dampening-solution applicator roller 13. Thereafter, the dampening-solution applicator roller 13 and the ink applicator rollers 9 to 12 are brought into contact with or thrown onto the plate cylinder 1. The transfer cylinder 2 is then brought into contact with or thrown onto the plate cylinder 1, a sheet 5 is fed to the surface of the impression cylinder 3, and the transfer cylinder 2 is brought into contact with or thrown onto the sheet 5 as soon as the latter is in the printing nip. When the printing operation is switched off, respectively, at the instants of time $t_1$, $t_3$, $t_5$, $t_7$, $t_9$, $t_{11}$ and $t_{max}$, the operations occur in reverse sequence.

To simplify the description herein, it is assumed that the sheet-fed offset printing machine prints at uniform speed after being switched on. Before the start of printing, i.e., before the time $t_0$, the job-specific data are entered or down-loaded into the control device 7. Inter alia, information is entered as to whether the dampening solution 22 contains alcohol or not, whether printing takes place using UV-curing (ultraviolet-curing) printing inks or standard inks, and whether the circumferential speeds of the plate cylinder 1 and the dampening-solution applicator roller 13 are different or not. Furthermore, numbers $n_1$, $n_2$, $n_3$ of revolutions of the plate cylinder 1 are entered, $n_1$ being the number after which the rotational speed of the dampening roller 21 changes from a production or continuous printing value to a print interruption value. $n_2$ represents the number of revolutions during which the rotational speed of the dampening roller 21 is reduced from the production printing value to the printing interruption value. $n_3$ represents the number of revolutions after which the dampening-solution applicator roller 13 is brought out of contact with or thrown off from the plate cylinder 1. Furthermore, two frequency values $H_1$, $H_2$ for the number of interruptions in a specific time interval are entered. A time duration T and numbers $n_4$, $n_5$ of revolutions of the plate cylinder 1 are preentered as parameters for controlling the predampening before printing. The time duration T corresponds to a predefined duration of an interruption. n4 corresponds to the number of revolutions of the plate cylinder 1 during which, before the start of printing, the dampening roller 21 is operated at a maximum rotational speed. $n_5$ represents the number of revolutions of the plate cylinder 1 during which the rotational speed of the dampening roller 21 corresponds to a production printing value. The foregoing and other information, on the one hand, and values or variables, on the other hand, are stored in the control device 7 as parameter sets, which can be downloaded as required.

Figure 3:
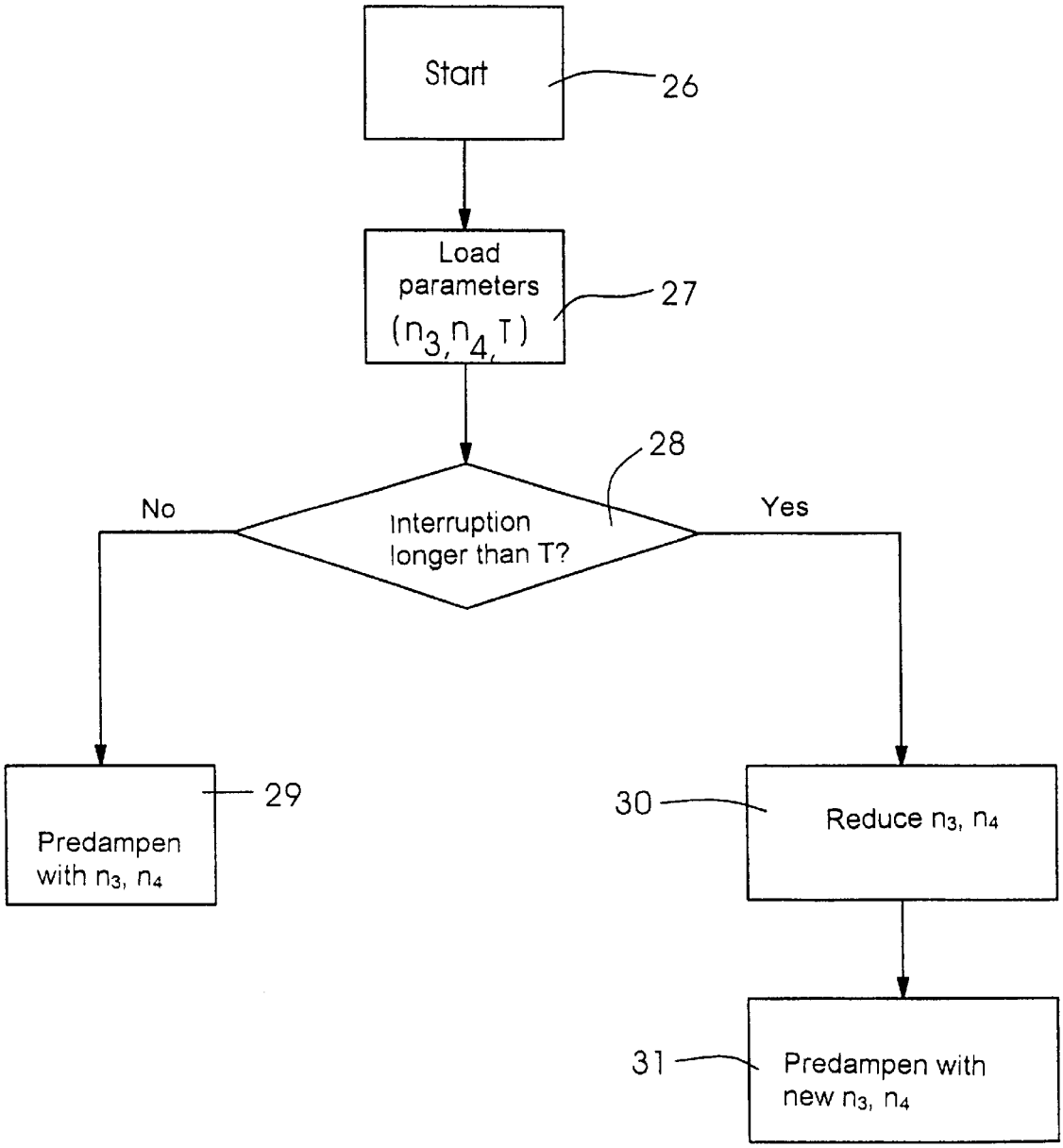
FIG. 3 is a flow diagram with method steps for predampening.

FIG. 3 shows the method steps which are executed during a printing start-up. After a start command has been given in the control device 7 in a step 26, the parameter set $n_4$, $n_5$, T suitable for the print job is downloaded in a step 27. A check is made in a step 28 as to whether the time duration of the interruption is greater than the time interval T. If this is not so, predampening is performed in a step 29, using the parameters $n_4$, $n_5$ and printing is subsequently started. If the time duration of an interruption exceeds the time limit T, then in a step 30 the numbers $n_4$, $n_5$ are reduced inversely proportionally to the duration of the interruption. In the following step 31, predampening is performed with the reduced numbers $n_4$, $n_5$.

Figure 4:
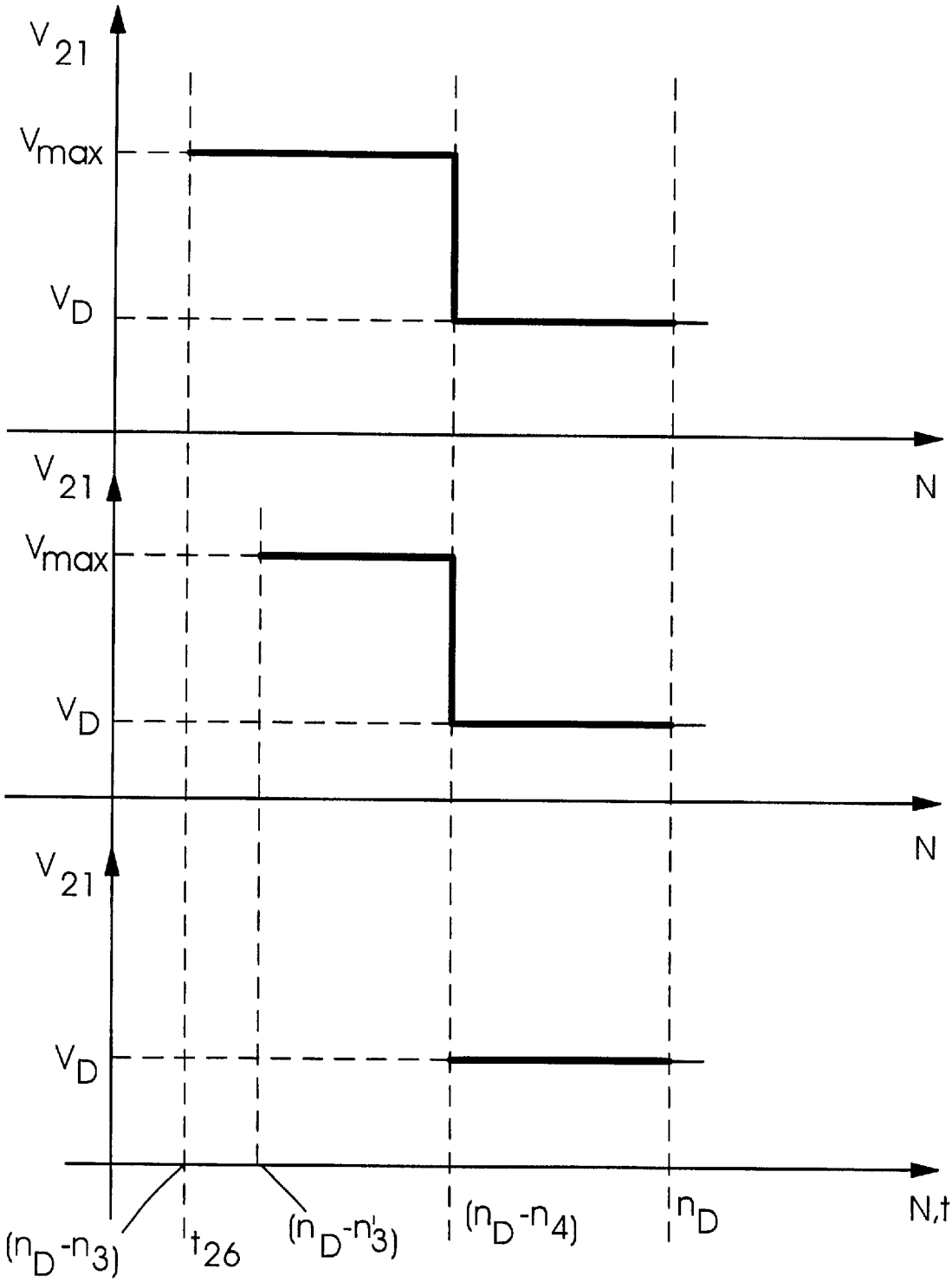
FIG. 4 is a series of plot diagrams or graphs depicting the time rate of change of the predampening process.

Predampening is illustrated in greater detail in FIG. 4. In the three plot diagrams or graphs, the number N of machine revolutions and, respectively, the time t are illustrated in the horizontal direction, i.e., along the abscissa. Plotted in the vertical direction, or along the ordinate, is the speed $V_{21}$ of the dampening roller 21. The speed $V_{21}$ is proportional to the amount of dampening solution 22 applied to the surface of the plate cylinder 1. The upper graph shows the variation of the speed $V_{21}$ during a long-lasting print interruption and during the execution of steps 30 and 31. If the start signal for printing is given at a time $t_{26}$, then a maximum amount of dampening solution is supplied to the surface of the plate cylinder 1, the dampening roller 21 rotating at maximum speed $V_{max}$. This begins $n_4+n_5$ machine revolutions before the first print after the interruption is produced, beginning at machine revolution $n_D$. After $(n_0-n_5)$ machine revolutions beginning from the starting time $t_{26}$, the rotational speed of the dampening roller 21 is reduced to a production printing value $V_D$, and maintained during printing beginning at the machine revolution $n_D$. The number of machine revolutions $(n_4)$ during which the maximum amount of dampening solution is supplied reduces as the duration of the print interruptions reduces. These facts are illustrated in the central and lower graphs for a short print interruption and for a very short print interruption. As the central graph reveals, the number $n_4+n_5$ of machine revolutions during which predampening is to occur was reduced to the value $n_4'+n_5$ by comparison with the case shown at the top. The number $(n_4)$ of machine revolutions during which predampening is to take place with the maximum amount of dampening solution is likewise reduced to a value $(n_{4'})$. If the duration of the interruption is very short, predampening with the maximum amount of dampening solution is omitted. Within $n_6$ machine revolutions, predampening of the printing plate with a supply rate corresponding to that of production printing takes place, the dampening roller 21 rotating at the speed $V_D$.

Figure 5:
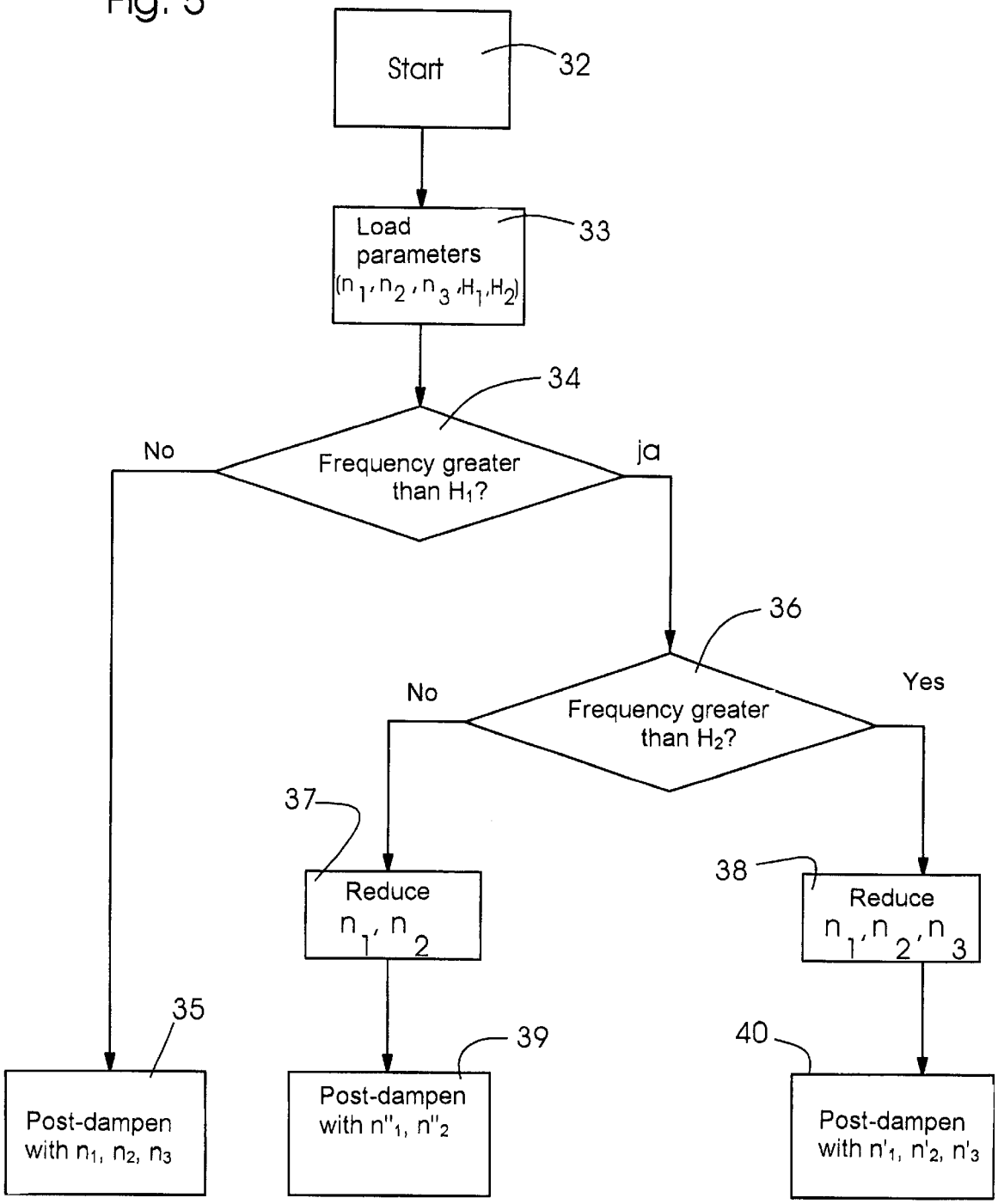
FIG. 5 is a flow diagram with method steps for after or post-dampening.

The flow diagram in FIG. 5 shows in greater detail the method steps which are executed when printing is switched off. In a step 32, a signal to switch off is given. In a following step 33, the job-specific parameter set $n_1$, $n_2$, $n_3$, $H_1$, $H_2$ for after or post-dampening the printing plate is downloaded. First of all, a check is made in a step 34 as to whether the frequency of the interruptions which have occurred previously in a defined time interval is greater than the limiting value $H_1$. If this does not apply, after-dampening takes place with the unchanged parameters $n_1$, $n_2$, $n_3$, according to a step 35. If a relatively large number of print interruptions have occurred in the past, then a check is made in a further interrogation step 36 as to whether the frequency of the interruptions which have occurred previously in a defined time interval is greater than the limiting value $H_2$. If this is not so, the values $n_1$, $n_2$ are reduced in a step 37; otherwise, the values $n_1$, $n_2$, $n_3$ are reduced in a step 38. The amount of the reduction depends upon the amount by which the number of interruptions deviates from the limiting value $H_2$. After or post-dampening of the surface of the plate cylinder 1 with the reduced values $n'_1$, $n'_2$, $n'_3$, $n''_1$, $n''_2$ is, respectively, performed in steps 39 and 40.

Figure 6:
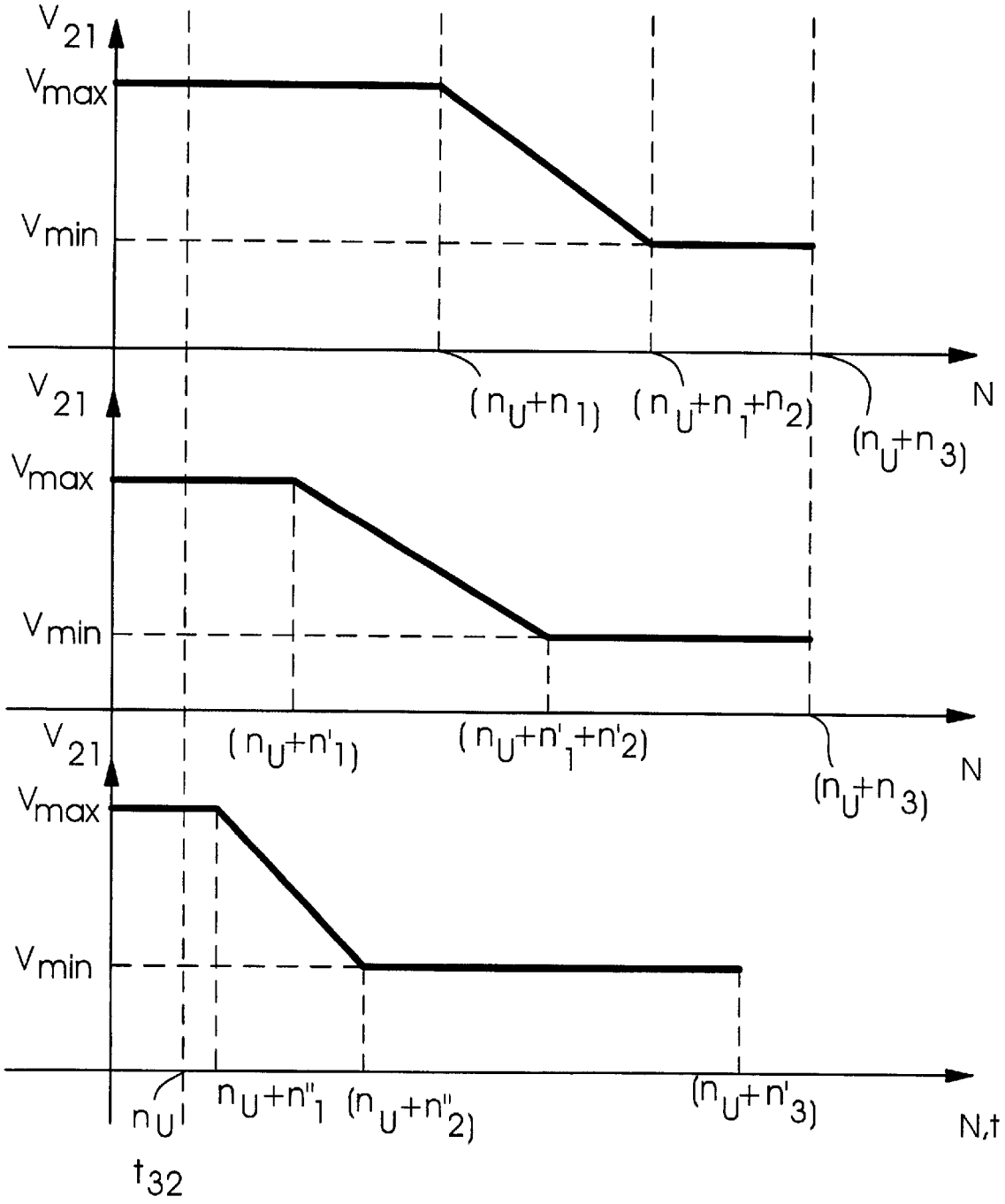
FIG. 6 is a series of plot diagrams or graphs depicting the dampening-solution rate of change during after or post-moistening.

After or post-dampening is shown in greater detail in three graphs in FIG. 6. The number N of machine revolutions and the time t, respectively, are illustrated on the horizontal axes or abscissas. Plotted on the vertical axes or ordinates is the speed $V_{21}$ of the dampening roller 21, which is proportional to the amount of dampening solution used for after or post-dampening. The upper graph shows the variation of the speed $V_{21}$ for print interruptions which occur relatively seldom during the processing of step 35. The central graph relates to cases with frequent print interruption, steps 37 and 39 being carried out. The lower graph shows the variation in the case of very frequent interruptions, and contains the operating steps 38 and 40. If, in the case of print interruptions occurring seldom, the stop signal is issued at a time $t_{32}$, then the last sheet 5 is printed during the machine revolution $n_u$. For the purpose of after or post-dampening, the sheet-fed printing machine continues to rotate for $n_3$ revolutions. In this regard, $n_1$ machine revolutions after the initiation of the print interruption, initially just the amount of dampening solution needed for the continuation of the print is supplied to the surface of the printing plate, the dampening roller 21 rotating at the speed $V_{cont.\ print}$. Then, within $(n_2)$ machine revolutions, the speed of the dampening roller 21 is reduced to a value $V_{no\ print}$, which is maintained until the $n_3$ machine revolutions are reached. After the $n_3$ machine revolutions have elapsed, the supply of dampening solution is turned off. In the case of relatively frequently occurring printing interruptions, the speed of the dampening roller 21 is reduced earlier from $V_{cont.\ print}$ to $V_{no\ print}$, $n_1$ being reduced to $n'_1$, and $n_2$, being reduced to $n'_2$. When printing interruptions have occurred very frequently in the past, the amount of dampening solution supplied for after or post-dampening can be reduced even further. As can be seen in the lower graph, the values $n'_1$, $n_2$, $n_3$ have been reduced to $n''_1$, $n''_2$, $n'_3$. Due to the reduction from $n_3$ to $n'_3$, after or post-dampening has been reduced altogether in terms of time in comparison with the cases shown in the center and upper graphs.

We claim:

1. A method of metering dampening solution when printing with printing form for offset printing, including, with a control device, setting an amount of dampening solution on the surface of the printing form to a predetermined value before starting to print, which comprises, following one interruption in the printing, determining the number of interruptions which have occurred previously in a predefined time interval, and varying in accordance with the number of interruptions the amount of dampening solution supplied to the surface of the printing form during the one interruption.

2. The method according to claim 1, which includes additionally determining the duration of the interruptions which have occurred previously in the predefined time interval, and increasing the amount of dampening solution supplied to the surface of the printing form during the one interruption, if the duration of the interruptions is increasing.

3. The method according to claim 1, which includes applying the dampening solution to the surface of the printing form by rollers, and reducing the speed of one of the rollers timely and more rapidly during the one interruption when the number of interruptions is increasing.

* * * * *